US007972058B2

(12) United States Patent
Furey

(10) Patent No.: US 7,972,058 B2
(45) Date of Patent: Jul. 5, 2011

(54) APPARATUS AND METHOD FOR MIXING WITH A DIAPHRAGM PUMP

(75) Inventor: James Francis Furey, Plainsboro, NJ (US)

(73) Assignee: PendoTECH, Plainsboro, NJ (US)

( * ) Notice: Subject to any disclaimer, the term of this patent is extended or adjusted under 35 U.S.C. 154(b) by 847 days.

(21) Appl. No.: 11/886,288

(22) PCT Filed: Mar. 15, 2006

(86) PCT No.: PCT/US2006/009281
§ 371 (c)(1),
(2), (4) Date: Sep. 12, 2007

(87) PCT Pub. No.: WO2006/101883
PCT Pub. Date: Sep. 28, 2006

(65) Prior Publication Data

US 2008/0279039 A1 Nov. 13, 2008

Related U.S. Application Data

(60) Provisional application No. 60/662,265, filed on Mar. 16, 2005.

(51) Int. Cl.
*B01F 11/00* (2006.01)

(52) U.S. Cl. ..... 366/275

(58) Field of Classification Search ..... 366/275, 366/118, 114
See application file for complete search history.

(56) References Cited

U.S. PATENT DOCUMENTS

| | | | |
|---|---|---|---|
| 2,124,983 | A | 7/1938 | Martin |
| 5,052,813 | A | 10/1991 | Latto |
| 5,234,605 | A | 8/1993 | Reipur et al. |
| 6,544,424 | B1 | 4/2003 | Shevitz |
| 6,837,610 | B2 * | 1/2005 | Cadogan et al. ..... 366/144 |

OTHER PUBLICATIONS

Bader et al., "A Disposable Mixing System for Hydrating Powdered Media and Reagents," BioProcess Internaitonal Apr. 2005, 3 pages.
Anonymous, "An integrated single-use sterile system for mixing and maintaining homogenous aqueous solutions," HyClone, undated, 2 pages.
Anonymous, "Low Shear Sanitary Diaphragm Pump for Gentle Pumping Applications in Bioprocessing," PendoTech, copyright 2005 Pendotech, 4 pages.
Dutton, "In Silico Tools Streamline Drug Design," Genetic Engineering News, Feb. 2006 , 4 pages.
Furey, "Optimizing Your Process Unit Operations," Genetic Engineering News, vol. 25, No. 20, Nov. 2005 2 pages.

* cited by examiner

*Primary Examiner* — Tony G Soohoo
(74) *Attorney, Agent, or Firm* — Hoffman & Baron, LLP

(57) ABSTRACT

An apparatus for mixing a fluid including a storage vessel including a hollow portion for holding the fluid, the hollow portion including at least one access port, the at least one access port adapted to at least one of receive and expel fluid and a diaphragm pump in fluid communication with and removeably coupled to the vessel, the pump adapted to move fluid into and/or out of the hollow portion. Either the vessel or the pump can be disposable. Also, at least one portion of the vessel can be made of a flexible material that takes shape in relation to the contents of the hollow portion. Also, the fluid can be moved between the vessel and the pump by natural or artificial pressure.

23 Claims, 5 Drawing Sheets

APPARATUS AND METHOD FOR MIXING WITH A DIAPHRAGM PUMP

The present application claims priority to provisional patent Application Ser. No. 60/662,265, filed Mar. 16, 2005. This earlier filed provisional application is incorporated herein by reference.

BACKGROUND OF THE INVENTION

Many applications for processing in industry require mixing two or more components to make a mixture homogeneous. Generally, such mixing is performed using internal mechanical devices immersed in the fluid, such as paddles or impellers. However, this type of mixing has some limitations and drawbacks. In certain applications, such as the chemical or biotechnological arts, it is desirable to have mixing processes that are sterile and free of contamination from the outside environment. The introduction of mechanical devices into a fluid can introduce contaminants, thus requiring re-sterilization of such devices each time they are used. Such a re-sterilization process can have added costs and delays that are not desirable. Also, re-sterilization requires high quality components that can withstand the added wear, which can also increase costs.

Additionally, some fluid mixtures have delicate components that are prone to shear. For example, an impeller moving quickly through a fluid can decrease cell culture viability or cause cell death therefore decreasing culture productivity. Thus, it is useful to have a mixing apparatus without the use of mechanical devices that might introduce contaminants and/or risk damaging the components of the fluid itself.

Further, mixing applications that use recirculating tubes leading to a peristaltic pump, for example, are susceptible to ruptures or leaks in those tubes or related couplings. The integrity of tubing, conduits and coupling seals can be compromised by fluid pressure and other factors.

Alternatively, mixing is performed by external movement of an entire fluid vessel, such as rocking or rotating. However, moving an entire fluid vessel with all its ports, probes, and connections is sometimes impractical and often requires large cumbersome devices. It is therefore desirable to provide a mixing system that does not compromise or interfere with the ports, probes and connections of the fluid vessel, or require bulky apparatus to accomplish the task.

SUMMARY OF THE INVENTION

The present invention includes an apparatus for mixing a fluid, having a storage vessel with a hollow portion for holding the fluid, the hollow portion including at least one access port for fluid input/output fluid. A diaphragm pump is in fluid communication with, and removeably coupled to, the vessel, and is adapted to move fluid into and/or out of the hollow portion. The storage vessel and/or the diaphragm pump can be disposable.

In one aspect of the present invention, the hollow portion has at least one access port adapted to receive and/or expel fluid. The pump can include a fluid chamber housing, secondary chamber housing, and a flexible membrane disposed between the fluid chamber housing and the secondary chamber housing, the fluid chamber housing being in fluid communication with the hollow portion of the vessel. The fluid expelled from the pump into the hollow portion can be adapted to homogenize the fluid mixture. Additionally, the expelled fluid can impart a rotation flow to fluid within the hollow portion. Also, at least one portion of the vessel can be made of a flexible material that takes shape in relation to the contents of the hollow portion. Additionally, the hollow portion can include a tapered portion narrowing toward at least one access port. The vessel can include at least one additional access port providing at least one additional opening into the hollow portion.

In another aspect of the present invention, the vessel includes at least one flexible portion adapted to change shape to conform to at least a portion of the fluid. A diaphragm pump in fluid communication with the vessel is adapted to draw fluid from the vessel and/or another source of fluid, and expel fluid to the vessel and/or another destination. At least a portion of the fluid mixture can be contained within a hollow portion inside the vessel, the hollow portion can narrow toward an access port providing fluid communication between the vessel and the pump. The pump can include an outer casing having a first member forming the outer walls of a fluid chamber, the first member including a radially protruding first flange, a second member can form the outer walls of a secondary chamber, the second member including a radially protruding second flange, the first flange being secured to the second flange. Also, the first and second flanges can be secured by a locking collar that is threadedly engaged with the first and/or second flange. Alternatively, the first and second flanges can be permanently secured to form a unitary pump housing.

In yet another aspect of the current invention, a system for mixing fluid includes a storage vessel capable of holding the fluid mixture, and a diaphragm pump coupled to the vessel for moving at least a portion of the fluid mixture. The pump includes a housing formed by a first portion and a second portion. The first portion includes a radially protruding first flange and the second portion including a radially protruding second flange. Also, the first and second flanges are secured by a collar. That collar can be threadedly engaged with the first and/or second flanges. A flexible barrier is disposed between the first and second portions, and defines at least one chamber inside the pump. This chamber is in fluid communication with the vessel. At least one portion of the vessel can be made of a flexible material such as a flexible bag or sack that takes shape in relation to the contents of the vessel. Also, the vessel can include a tapered inner chamber narrowing toward a diaphragm pump coupling. The storage vessel and/or the diaphragm pump can be disposable after a single use. Alternatively, the first portion of the housing and the flexible material can be disposable.

In yet another aspect of the current invention, a method for mixing a fluid includes providing a storage vessel including a hollow portion for holding fluid. The hollow portion has at least one access port adapted to receive and/or expel fluid. A diaphragm pump is provided and coupled to the vessel so that it is in fluid communication with the hollow portion. The hollow portion is then filled, or at least partially filled, with a fluid to be mixed. Then a control system is initiated to get the pump to move at least part of the fluid either into or out of the hollow portion. The pump is then removed from the vessel. The vessel and pump can include the features and elements discussed above. In particular, some or all of the elements can be made for single or limited use.

These and other objectives, features, and advantages of this invention will become apparent from the following detailed description of illustrative embodiments thereof, which is to be read in connection with the accompanying drawings.

DETAILED DESCRIPTION OF THE INVENTION

The present invention relates to a method and system for mixing a fluid using a diaphragm pump in combination with a fluid vessel. The fluid mixture can be a composition of disparate fluids or one or more fluids combined with other solid matter. The fluid mixture is preferably drawn from the vessel into the diaphragm pump and then expelled back into the vessel. Using the preferred diaphragm pump of the present invention, the number of elements that come in contact with the mixing fluid are minimized, while providing a low shear, efficient, low cost method and system of fluid mixing. It should be noted that references herein to a fluid "vessel" or "storage vessel" are to a hollow container or receptacle for a fluid or fluid mixture.

Figure 1:
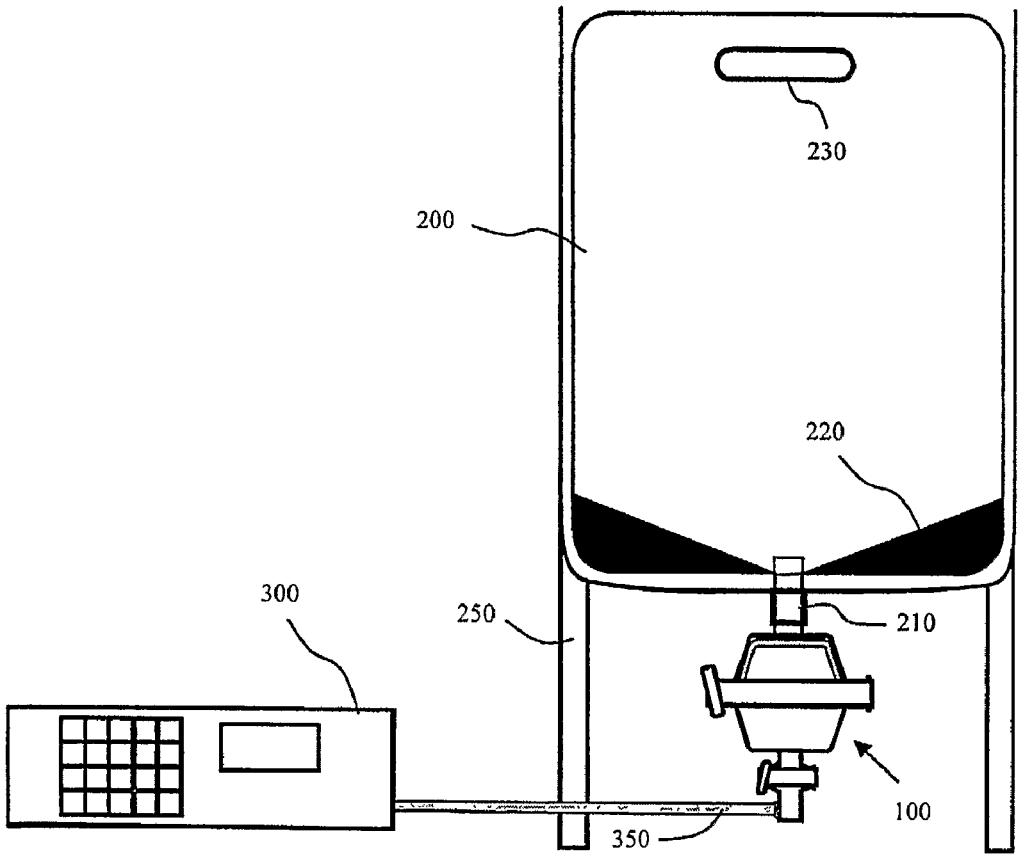
FIG. 1 is a schematic view of an embodiment of a fluid mixing apparatus and system in accordance with the subject invention.

With reference to the drawings, FIG. 1 shows a fluid mixing apparatus including a diaphragm pump 100 in fluid communication with a fluid storage vessel 200. The storage vessel 200 is generally suited to hold a desired fluid mixture. The diaphragm pump 100 is preferably adapted to move fluid into and/or out of the vessel 200. In this embodiment, the pump 100 is preferably mounted below the flexible vessel 200, in order to take advantage of the pressure head that drives the fluid mixture toward the bottom fluid port 210. Additionally, control equipment 300 can supply/remove compressed air to the pump 100 through a gas inlet/exhaust line 350. Thus, a portion of the fluid mixture can be drawn out of the vessel 200, into the pump 100, and then returned to the vessel 200 causing a recirculation of the entire fluid mixture within the vessel 200.

In a preferred embodiment, the vessel 200 is a bioreactor with a diaphragm pump 100 connected to the bottom of the vessel 200. The fluid mixture can include mammalian cells that are frequently used for production of biological products. Cells in a bioreactor must remain mixed and have equal access to nutrients, oxygen and maintained at a proper pH. Mammalian cells lack a cell wall and are shear sensitive, thus preferably mixed used a low shear technique.

The embodiment shown in FIG. 1 demonstrates a sealed flexible vessel 200 that is preferably made of a durable, yet flexible polymer film. It is preferred, in this embodiment that the vessel 200 is like a sealable bag or sack. In this way the entire vessel is flexible, however, a portion of the vessel could be made rigid. Thus, a rigid frame 250 can be provided to support this flexible vessel 200. Also, a handle 230 can be incorporated into the vessel 200 or added thereon. Further, the bottom portion 220 of the vessel 200 can include a tapered, conical or angled segment to reduce dead circulation zones within. This embodiment provides only a single fluid port 210, which preferably is coupled to the diaphragm pump 100. The fluid port 210 or any other added port should be of a design not to obstruct the mixing process. While it is understood that additional ports could be added, a more simple single fluid port 210 configuration can reduce the cost of such a vessel 200. Also, a single fluid port 210 can minimize the sources of leaks and/or contaminants into the vessel 200. However, it is understood that additional ports are desirable for introducing gases, liquids and other elements, as well as removing a portion or all of the fluid mixture. Nonetheless, a flexible vessel 200 is desirable in the single fluid port 210 embodiment, as it allows fluid to exit the vessel 200 into the pump 100 or other destination without creating a vacuum in the vessel 200. Alternatively, a portion of the vessel can be made rigid, with a flexible portion remaining to allow the vessel 200 to contract.

Figure 2:
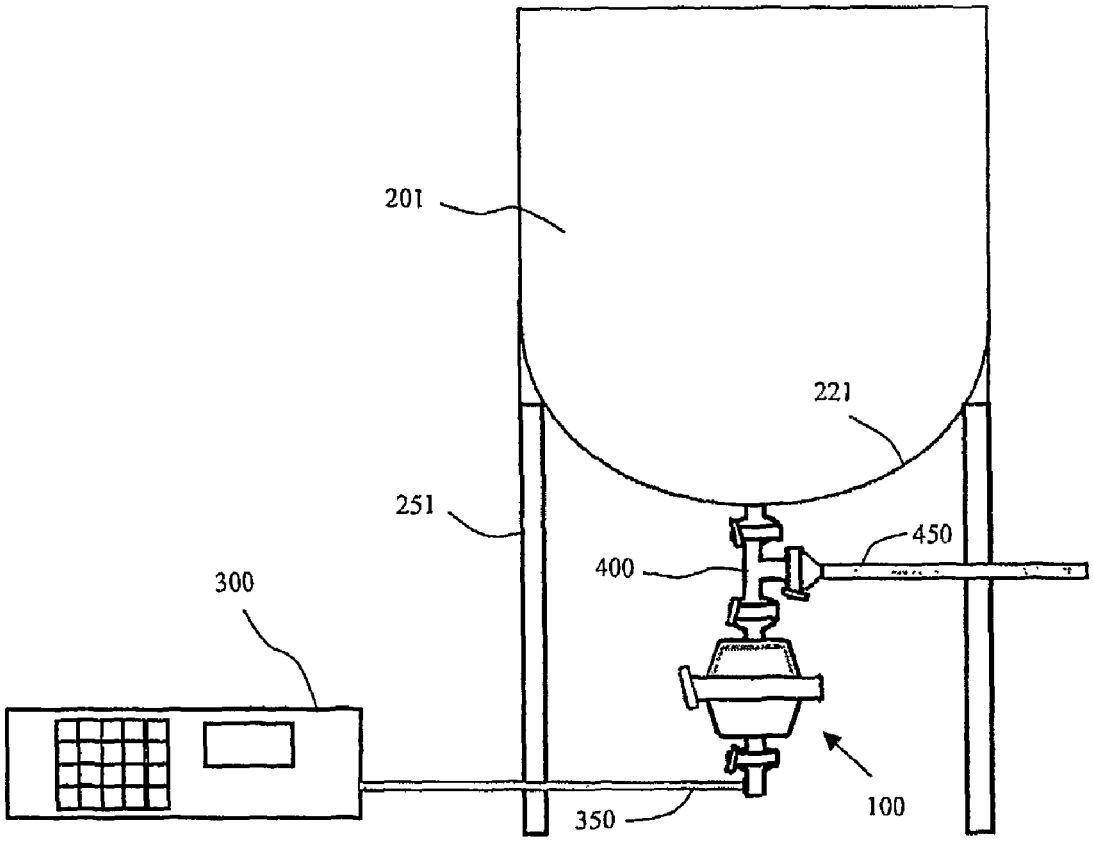
FIG. 2 is a schematic view of an alternate embodiment of a fluid mixing apparatus and system in accordance with the subject invention.

The embodiment shown in FIG. 2 demonstrates an alternative rigid fluid vessel 201 with a semispherical bottom 221. It should be noted that although a taper 220 or curvature 221 is included in the preferred embodiment, the vessel or even just the bottom portion could be almost any shape or size. Similar to the first embodiment, a rigid vessel 201 can also be provided with a support frame 251. The vessel 201 could be made of metal, ceramic, plastic, or other materials that suit a particular application. Even rigid or semi-rigid composite materials could be used.

With regard to both the flexible and rigid vessel embodiments discussed above, the vessel 200, 201 can comprise any suitable disposable material, as is known in the art. It should be noted that references herein to the term "disposable" are to elements that are designed to be thrown away or discarded after a single or very limited number of uses. The material can be, for example, a polymer, and specifically a thermoplastic polymer that can be formed into a thin, durable, collapsible vessel. Because a disposable mixing system can be placed inside of a supporting structure (where a temperature control device can also be provided) that approximately matches the external vessel shape when filled, materials will generally be chosen for their workability and durability. For example, materials that can easily be molded and ported are desirable, for example materials that can be sealed at their edges around ports and/or for which a port welder can be used. Examples of suitable materials include, but are not limited to polyethylene, ethylene vinyl acetate, ethylene vinyl alcohol, polypropylene, nylon, polyester, poly(vinyl chloride) and mixtures of the foregoing. Further examples of suitable materials are given in a 1997 Association of the Advancement of Medical Instrumentation Technical Information Report designated—TIR17-1997 (hereinafter referred to as "AAMI 1997").

Further, the vessel 200, 201 can be formed into any suitable shape, for example, a roughly cylindrical shape, optionally having a conical or tapered portion 220 at the bottom. As will be recognized by one of skill in the art, many variations are possible and within the scope of this invention. Further, the vessel 200, 201 can be made to any convenient size, from relatively small bench top type mixing systems to large, industrial scale mixing systems. The valve systems, tubing, pumps, and vessels described herein throughout can likewise be increased in size and/or capacity to provide a mixer and mixing systems of various sizes.

The optional tapered portion 220 can be formed as needed to obtain the desired flow. The tapered portion 220 can begin anywhere. In various embodiments, it can begin at any point below the vertical middle of the vessel 200, 201, and can taper at any angle. Also, the narrow fluid port 210 can have any suitable width. Preferably, the transition from the pump 100 into the vessel 200, 201 through the fluid port 210 is unobstructed. Any obstruction in this region can reduce the force in which the fluid is propelled into the vessel by the pump 100. Such a reduction in force could reduce the effective mixing within the vessel 200, 201. In other embodiments, the fluid vessel 200, 201 can be formed in a complete cone shape having a continuous taper from the bottom to the top.

Also, the vessel 201 may have inlet/exliaust ports that are in addition to the fluid port 210, depending on the application for which the vessel is used. Ports may be used for probes, component addition, drains, sampling or venting. For example, a bioreactor often requires the measurement of pH, dissolved oxygen, or temperature. Also necessary in some applications is the sampling, venting or the addition of components. Such applications would benefit from additional inlet/exhaust ports. Also, a closed rigid vessel would need an added port to allow fluid to be removed without creating a vacuum in the vessel. The vessel 201 shown in FIG. 2 simply includes an open top configuration. While such an open configuration may have limited application, it is inexpensive to construct and functions as a very accessible port. As with the flexible vessel 200 embodiment discussed above, a rigid vessel 201 can take advantage of a configuration that includes mounting the diaphragm pump 100, 101 below the vessel 200, 201. Additionally, by directing the fluid 50 expelled from the diaphragm pump 101 toward the liquid/air surface, it can further enhance the mixing process.

Other elements, such as the valves and fluid T-coupling 400 shown in FIG. 2, can be added to the first embodiment, discussed above. A T-coupling 400 can be placed between the vessel 200, 201 and the pump 100 with a top valve (not shown) placed between the T-coupling 400 and the vessel 200, 201 and a lateral valve (not shown) on the lateral side of the T-coupling 400 to facilitate removal of fluid from the vessel 200, 201. When drawing fluid into the pump 100, the top valve is preferably open and the lateral valve is preferably closed. When expelling fluid from the pump, the top valve is preferably closed and the lateral valve is preferably open. Thus, when expelling liquids or the fluid mixture in this way, the fluid would be pumped from the vessel 200, 201 to another destination via the fluid line 450. Such valves can also be automated in order to synchronize their timing to facilitate removing fluid from the vessel 200, 201. A similar yet reversed process could also be used to fill or add fluid to the vessel 200, 201. Also, preferably the same control equipment 300 operating the pump process could accomplish this.

Figure 3A:
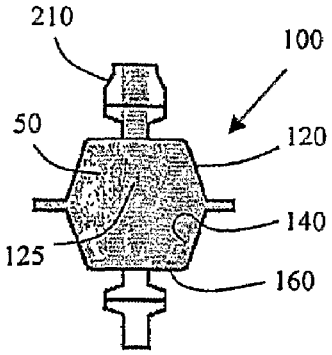
FIGS. 3*a-c* are cross-sectional views of a diaphragm pump filled, partially filled and emptied, respectively, of mixing fluid, in accordance with the subject invention.
Figure 3B:
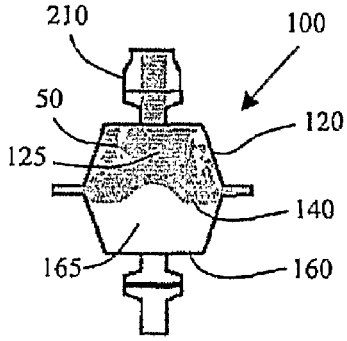
Figure 3C:
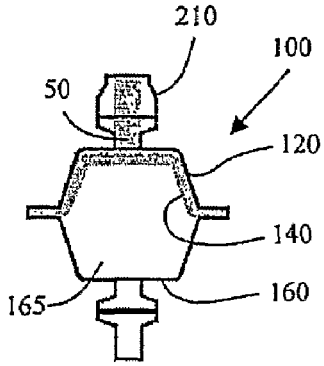

FIGS. 3*a-c* illustrate how the diaphragm pump 100 works in accordance with the preferred embodiment. The diaphragm pump 100 is preferably formed by an upper pump housing 120 and a lower pump housing 160, that when sealed together form the outer pump casing. Both the upper and low pump housings 120, 160 include a radially protruding flange that when mated together secure the diaphragm 140 there between. This configuration forms a fluid chamber 125 between the upper pump housing 120 and the diaphragm 140. In this way, the inner surface of the upper pump housing 120 and the upper surface of the diaphragm 140 are the only portions of the pump 100 that should come in contact with the fluid mixture 50. In contrast, a secondary chamber 165 is also formed between the lower pump housing 160 and the diaphragm 140. Preferably, the secondary chamber 165 does not ever come in contact with the fluid mixture 50.

The diaphragm pump 100 cycles between drawing-in liquid and expelling liquid from its fluid chamber 125. FIG. 3*a* shows the diaphragm 140 drawn toward the lower pump housing 160 and filling the pump 100 with the fluid mixture 50. As the diaphragm 140 is caused to move upward, toward the upper pump housing 120, the fluid mixture 50 is expelled through the fluid port 210. FIG. 3*b* shows an intermediary phase between those shown in FIGS. 3*a* and 3*c*. FIG. 3*c* shows the diaphragm 140 drawn toward the upper pump housing 120 and thus emptying the pump 100 of the fluid mixture 50.

The pump can draw liquid in by different means including mechanical elements such as a piston (not shown), natural or artificial pressure, and/or a vacuum on the secondary side of the pump. The pump 100 can expel liquid by different means including a piston (not shown) or air/fluid pressure on the secondary side of the pump. In other words, the fluid mixture 50 and the diaphragm 140, 141 within the pump 100, 101 are moved by a pressure differential. For both drawing in liquid to the pump and expelling liquid, the rate of liquid flow can be controlled to achieve the desired mixing process. In the case of using air pressure or gravity, controlling the air flow rate in and out of the secondary side of the pump can control liquid flow rate. In the case of a piston, the piston speed can control the rate of liquid flow. Also, air pressure alone can be regulated to expel liquid from the pump without controlling the air flow rate. Thus, by regulating the natural and/or artificial pressure, the fluid flow rate can be controlled.

The pump volume related to the vessel volume would vary and depend on the process and mixing application, such as available time, temperature, components. The pump can either completely fill or partially fill or completely empty or partially empty depending on the desired outcome. The pump and vessel shape would vary depending on the process application. The pump flow or pressure would be adjustable to create sufficient velocity at the point of connection to the vessel to create upward liquid flow to enhance mixing.

Figure 4:
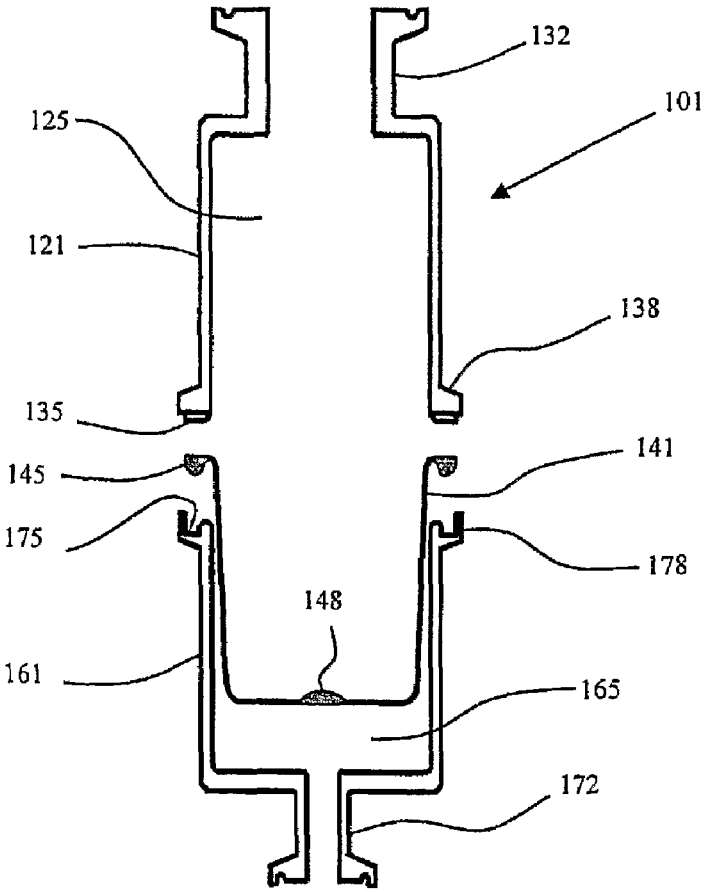
FIG. 4 is an exploded cross-sectional view of a diaphragm pump in accordance with the subject invention.

FIG. 4 shows an exploded view of an alternative diaphragm pump 101 that has a more cylindrical shape. As with the previous pump embodiments, the pump 101 preferably includes a mixing fluid port 132 on the top side of the pump and pressure supply port 172 on the bottom of the pump. In this embodiment, the upper pump housing 121 still includes an upper coupling flange 138 that when mated to the lower coupling flange 178 is adapted to receive a sanitary clamp. Also, the upper and lower housings 121, 161 respectively include a sealing surface 135 and a sealing seat 175 engaging and securing both sides of the diaphragm 141.

The diaphragm 140, 141 is preferably a flexible membrane that allows the pump to intake and expels liquid while maintaining a seal. The membrane 140, 141 should be made of a durable and flexible material like silicone, a thermoplastic polymer or other suitable materials, such as those given in AAMI 1997. Preferably, the diaphragm 141 is provided with a bulbous radial flange 145 that acts as a sealing ring when sandwiched between the upper and lower housings 121, 161. Also, the diaphragm 141 can have a reinforced portion at its center 148, as well as other portions (not shown) as desired. As a further alternative, the diaphragm 140, 141 could be reinforced with fabric or other materials, either embedded or joined to one side, as might be suited to a particular application.

Figure 5A:
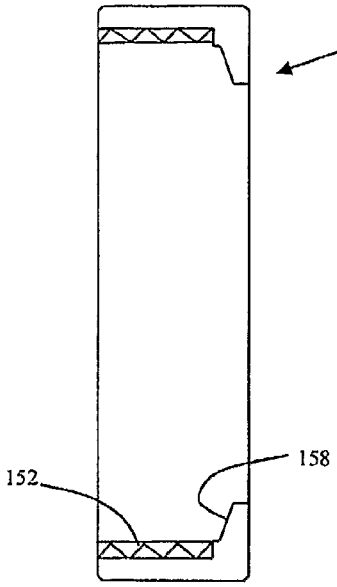
FIGS. 5*a-b* are a side cross-sectional view and a bottom view, respectively, of a diaphragm pump locking collar, in accordance with the subject invention.
Figure 5B:
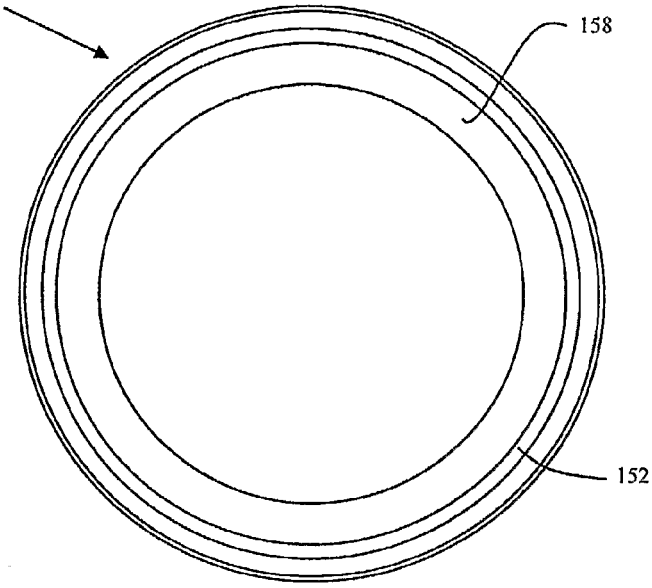
Figure 6A:
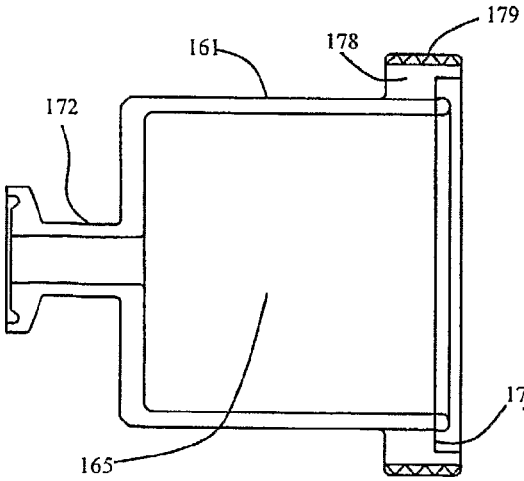
FIGS. 6*a-b* are a side cross-sectional view and a top view, respectively, of an alternate embodiment of a portion of diaphragm pump housing adapted to receive the locking collar of FIGS. 5*a-b*, in accordance with the subject invention.
Figure 6B:
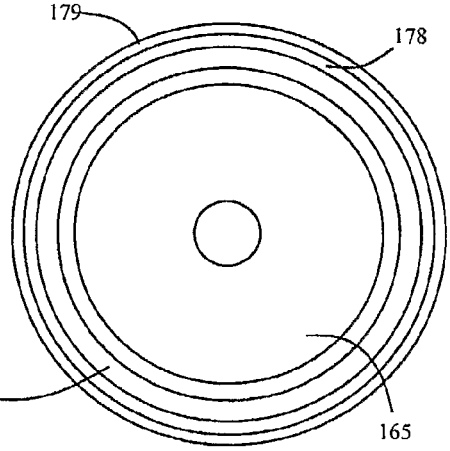

The upper and lower coupling flanges 138, 178 can be secured using a contemporary sanitary clamp (not shown). However, an alternate embodiment shown in FIGS. 5 and 6 uses a locking collar 150 to maintain the seal in the central portion of the pump 100. Preferably, the locking collar 150 as seen in FIGS. 5*a* and 5*b* is inserted around the outer cylindrical portion of the upper pump housing 121. The securing flange 158 is designed to engage the upper coupling flange 138. The lower pump housing 161 shown in FIGS. 6*a* and 6*b* includes male threading 179 on the outer circumference of the lower coupling flange 178. Those screw threads 179 are adapted to receive the female threading 152 on an inner circumference of the locking collar 150. Thus, such a locking collar provides a simple mechanical means of securing and sealing the pump 101. Preferably, the locking collar 150 is made from similar durable but inexpensive materials to those of the upper and lower pump housings 120, 121, 160, 161. This will ensure that any expansion or contraction of the locking collar due to temperature or pressure follows that of the housings 120, 121, 160, 161.

In a further alternative embodiment, the pump 100, 101 can be made integral with the flexible diaphragm 140, 141, providing a unitary element that is self-contained and easily added to or removed from a mixing assembly. To form such a unitary embodiment, two sections of a pump could be ultrasonically bonded with the diaphragm in place. However, the two flanges 138, 178 could be chemically bonded as well.

Both the use of a locking collar 150 and the unitary bonding techniques discussed above are particularly suited for a disposable or single use mixing system in accordance with the present invention. Because inexpensive materials and assembly techniques can be used to manufacture these elements, economies of scale can make it more cost effective and time efficient to use a new diaphragm pump 100, 101, vessel 200, 201 and/or other contaminated elements than to clean and re-sterilize those parts for reuse. Sterilization techniques such as the use of an autoclave can cause significant damage to many of the polymer materials discussed above, not to mention down-time or delays in the mixing process. Techniques typically used by end-users, such as gas or steam sterilization, are not particularly suited for closed vessels (the gas may not penetrate the entire vessel evenly), can also damage certain plastic materials and encounter similar delays. Other techniques such as gamma sterilization require large capital investments, and are not generally located on premises to the end-user. Thus, it is advantageous to perform the sterilization techniques during the assembly process and provide a relatively inexpensive product that can be disposed after a single or very limited number of uses.

Alternatively, the upper pump housing 120, 121 and the diaphragm 140, 141 could be the only elements intended to be disposable. As these are the only two elements of the pump 100, 101 that come in contact with the fluid mixture 50, replacing them provides a quick an easy way to re-sterilize the mixing assembly without talking time for cleaning in critical applications. Also, more of the assembly is re-usable by discarding only the contaminated portions. In this embodiment, the upper pump housing 120, 121 and the diaphragm 140, 141 could either be separate or provided in a preassembled state. Either these two disposable elements can be bonded together or temporarily secured using tape or a clamp to hold them together. In this way, these two disposable elements 120, 121, 140, 141 could be added to the rest of the assembly and then secured using a sturdy, reuse-able clamp. As in the embodiments discussed earlier, the clamp is preferably suited to hold the pump together under normal operating pressures and vibrations.

Figure 7A:
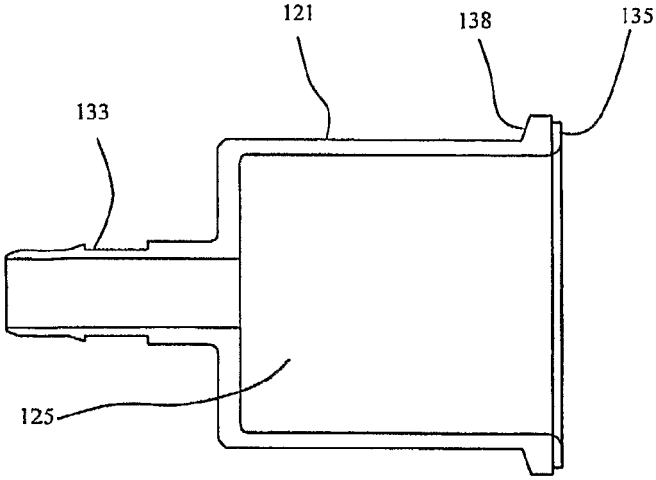
FIGS. 7*a-b* are a side cross-sectional view and a top view, respectively, of yet another alternate embodiment of a portion of diaphragm pump housing, in accordance with the subject invention.
Figure 7B:
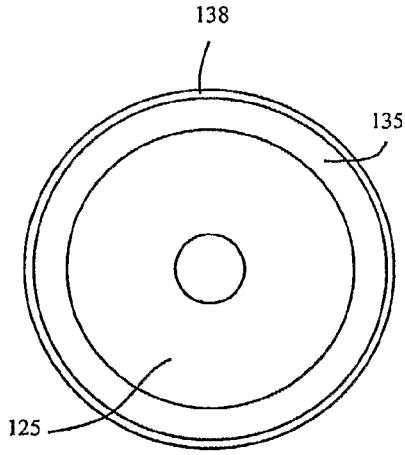

There are numerous means to connect the pump 100, 101 to the fluid port 210 at the bottom of the vessel 200, 201, as well as other couplings to valves or connectors, depending on the application and type of vessel. FIGS. 7*a* and 7*b* show an alternative fluid port coupling 133 that is suited for a slip-on hose or quick-disconnect coupling. In particular, fluid port coupling 133 includes a tubular projection with a hose barb. It is further understood that many known quickly connecting/disconnecting coupling techniques can be used in relation to the present mixing system. Similarly, the connection of the non-liquid side of the pump to the control system operating the pump could be altered as is known in the art.

A further element that should be noted with regard to the upper pump housing 120, 121, is that the upper coupling flange is designed to receive both a traditional sanitary clamp as well as the locking collar 150 of the present invention. Such is particularly suited for the embodiment discussed above where only the upper pump housing 120, 121 and diaphragm 140, 141 are disposable. In this way, a single type of upper pump housing 120, 121 could be manufactured to interchangeably fit both a non-disposable (more durable) and disposable lower pump housing.

As discussed above with regard to the materials used for the pump, container and connectors, it should be understood it is preferred that the couplings between the pump 100, 101 and vessel 200, 201 should be inexpensive, reliable and easy to manipulate and secure.

As discussed above with regard to the vessel 200, 201, the pump 100 could be made of metal, ceramic, plastic (see, AAMI 1997), or other materials that suit a particular application. However, a preferred embodiment is directed toward providing a pump that is made inexpensively and designed for single use. Such a disposable diaphragm pump is particularly suited for biological and chemical mixing processes that could benefit from an inexpensive mixing apparatus that can be relied upon to provide and maintain a sterile environment.

As a further alternative embodiment, more than one diaphragm pump 100, 101 may be coupled to the vessel 200, 201 to optimize the mixing process in particular applications. Multiple pumps 100, 101 could be used to augment or disrupt smooth fluid flow within vessel 200, 201, to alter the mixing. Also, the orientation of either the fluid port 210 or the coupling between the vessel 200, 201 and the pump 100, 101 can be configured to impart a rotational element to the flow of the fluid mixture within the vessel 200, 201. Either directing the expelled fluid at an angle, from the side, or other configuration to effect the flow of fluid within the vessel. Similarly, one or more fluid ports 210 could be located on the side of the vessel 200, 201, if better suited for a particular application. However, it is preferred that the fluid expelled from the pump 100, 101 into the vessel 200, 201 thoroughly mix the fluid to form a homogenous mixture.

While various embodiments of the present invention are specifically illustrated and/or described herein, it will be appreciated that modifications and variations of the present invention may be effected by those skilled in the art without departing from the spirit and intended scope of the invention.

What is claimed is:

1. An apparatus for mixing a fluid comprising:

a storage vessel including a hollow portion for holding said fluid, said hollow portion including a tapered portion narrowing toward an access port at a bottom of said storage vessel, said access port for receiving and expelling said fluid; and a disposable diaphragm pump in fluid communication with and removeably coupled to said vessel, said pump for moving fluid at least one of into and out of said hollow portion through said access port, wherein said pump includes a fluid chamber housing, a secondary chamber housing, and a flexible membrane disposed between said fluid chamber housing and said secondary chamber housing, said fluid chamber housing being in fluid communication with said hollow portion, said fluid chamber housing including a radially protruding first flange, said secondary chamber housing including a radially protruding second flange, said first flange being secured to said second flange.

2. The apparatus of claim 1, wherein said storage vessel is a disposable.

3. The apparatus of claim 1, wherein at least one portion of said vessel is made of a flexible material that takes shape in relation to the contents of said hollow portion.

4. The apparatus of claim 1, wherein said vessel includes substantially no additional openings into said hollow portion.

5. The apparatus of claim 1, wherein fluid expelled from said pump into said hollow portion is substantially directed at an oblique angle relative to a bottom of the storage vessel.

6. The apparatus of claim 1, wherein fluid expelled from said pump into said hollow portion substantially enters said hollow portion offset from a central longitudinal axis of said storage vessel.

7. The apparatus of claim 1, further comprising a T-coupling operatively coupled to said access port and said diaphragm pump, wherein fluid communication between said access port and said diaphragm pump passes through said T-coupling.

8. An assembly for mixing a fluid comprising:

(a) a vessel for holding a fluid, said vessel including at least one flexible portion adapted to change shape to conform to at least a portion of said fluid, said vessel including an access port for receiving and expelling said fluid from a bottom of said vessel; and (b) a diaphragm pump in fluid communication with said vessel, said pump operable to alternatively i) draw fluid from at least one of said vessel and another source of fluid, and ii) expel fluid to at least one of said vessel and another destination, said diaphragm pump including a fluid chamber housing, a secondary chamber housing, and a flexible membrane disposed between said fluid chamber housing and said secondary chamber housing, said fluid chamber housing being in fluid communication an inner hollow portion of said vessel.

9. The assembly of claim 8, wherein at least a portion of said fluid mixture is contained within said hollow portion inside said vessel, said hollow portion narrowing toward an access port providing fluid communication between said vessel and said pump.

10. The assembly of claim 8, wherein said vessel includes substantially no additional openings into said hollow portion.

11. The assembly of claim 8, wherein said diaphragm pump substantially expels fluid into said vessel from a portion of said vessel offset from a central longitudinal axis of said vessel.

12. The assembly of claim 8, wherein said pump includes a first member forming the outer walls of the fluid chamber, said first member including a radially protruding first flange, a second member forming the outer walls of the secondary chamber, said second member including a radially protruding second flange, said first flange being secured to said second flange.

13. The assembly of claim 12, wherein said first and second flanges are secured by a locking collar that is threadedly engaged with at least one of said first and second flanges.

14. The assembly of claim 12, wherein said first and second flanges are permanently secured to form a unitary pump housing.

15. The assembly for mixing a fluid of claim 8, further comprising a T-coupling operatively coupled to said access port and said diaphragm pump, wherein fluid communication between said access port and said diaphragm pump passes through said T-coupling.

16. A system for mixing fluid comprising:

a storage vessel capable of holding said fluid mixture, wherein at least one portion of said vessel is made of a flexible material that takes shape in relation to the contents of said vessel, said vessel including an access port for receiving and expelling said fluid from a bottom of said vessel; and a diaphragm pump in fluid communication with said vessel for moving at least a portion of said fluid mixture, wherein said pump includes a housing formed by a first portion and a second portion, said first portion including a radially protruding first flange, said second portion including a radially protruding second flange, said first and second flanges secured by a collar, a flexible barrier disposed between said first and second portions, and at least one chamber inside said pump, said chamber in fluid communication with said vessel.

17. The assembly of claim 16, wherein at least one said storage vessel and said diaphragm pump is disposable after a single use.

18. The assembly of claim 16, wherein said collar is threadedly engaged with at least one of said first and second flanges.

19. The assembly of claim 16, wherein said first portion and said flexible barrier are disposable.

20. The assembly of claim 16, wherein said vessel includes a tapered inner chamber narrowing toward a diaphragm pump coupling.

21. The assembly for mixing a fluid of claim 16, further comprising a T-coupling operatively coupled to said access port and said diaphragm pump, wherein fluid communication between said access port and said diaphragm pump passes through said T-coupling.

22. A method for mixing a fluid comprising:

providing a storage vessel including a hollow portion for holding fluid, said hollow portion including a tapered portion narrowing toward an access port at a bottom of said storage vessel, said access port for receiving and expelling said fluid, providing a diaphragm pump, wherein said pump includes a housing formed by a first portion and a second portion, said first portion including a radially protruding first flange, said second portion including a radially protruding second flange, said first and second flanges secured by a collar, said collar threadedly engaged with at least one of said first and second flanges, a flexible barrier disposed between said first and second portions, and at least one chamber inside said pump, coupling said pump to said vessel, said chamber being in fluid communication with said hollow portion, filling at least a portion of said hollow portion with a fluid to be mixed, initiating said pump to move at least a portion of said fluid to be mixed at least one of into and out of said hollow portion, and removing said pump from said vessel.

23. The method according to claim 22, wherein at least one said storage vessel and said diaphragm pump are disposable.

* * * * *